US012473171B2

(12) United States Patent
Deitlaff et al.

(10) Patent No.: US 12,473,171 B2
(45) Date of Patent: Nov. 18, 2025

(54) YARN FEED APPARATUS, WORKSTATION OF A CABLING MACHINE AND METHOD FOR FEEDING

(71) Applicant: Saurer Technologies Gmbh & Co. KG, Krefeld (DE)

(72) Inventors: Michael Deitlaff, Krefeld (DE); Cenk Duralti, Moenchengladbach (DE)

(73) Assignee: Saurer Technologies Gmbh & Co. KG, Krefeld (DE)

( * ) Notice: Subject to any disclaimer, the term of this patent is extended or adjusted under 35 U.S.C. 154(b) by 62 days.

(21) Appl. No.: 18/156,714

(22) Filed: Jan. 19, 2023

(65) Prior Publication Data

US 2023/0228004 A1 Jul. 20, 2023

(30) Foreign Application Priority Data

Jan. 20, 2022 (DE) ..... 102022101248.4

(51) Int. Cl.

| | |
|---|---|
| ***D01H 1/10*** | (2006.01) |
| ***B65H 51/16*** | (2006.01) |
| ***B65H 57/12*** | (2006.01) |
| ***D01H 13/04*** | (2006.01) |
| ***D01H 15/007*** | (2006.01) |
| ***D02H 1/00*** | (2006.01) |

(52) U.S. Cl.

CPC ..... *B65H 51/16* (2013.01); *B65H 57/12* (2013.01); *D01H 1/103* (2013.01); *D01H 13/045* (2013.01); *D01H 15/007* (2013.01); *D02H 1/00* (2013.01)

(58) Field of Classification Search

CPC .... D01H 1/103; D01H 13/045; D01H 15/007; B65H 51/16; B65H 57/12; B65H 67/083; B65H 2701/31

See application file for complete search history.

(56) References Cited

U.S. PATENT DOCUMENTS

| | | | | | |
|---|---|---|---|---|---|
| 2,728,132 | A | * | 12/1955 | Shattuck | D02H 3/00 242/157 R |
| 3,144,187 | A | * | 8/1964 | Naumann | B65H 51/16 226/97.4 |
| 3,981,128 | A | * | 9/1976 | Munker | B65H 65/00 57/58.7 |
| 4,120,142 | A | * | 10/1978 | Franzen | D01H 15/007 57/352 |
| 4,127,983 | A | | 12/1978 | Munker | |
| 4,163,357 | A | | 8/1979 | Greive et al. | |
| 4,392,340 | A | * | 7/1983 | Horstmann | D01H 13/16 57/264 |

(Continued)

FOREIGN PATENT DOCUMENTS

| | | | |
|---|---|---|---|
| DE | 2648621 | C3 | 11/1981 |
| DE | 2915915 | C2 | 2/1985 |

*Primary Examiner* — Shaun R Hurley

(74) *Attorney, Agent, or Firm* — Fox Rothschild LLP

(57) ABSTRACT

The invention relates to a yarn feed apparatus for a workstation of a cabling machine for feeding a creel yarn from a feed package arranged on a bobbin creel or from a transport conveyor arranged above the cabling machine to a cabling apparatus equipped with a cabling spindle and/or for feeding a starter yarn from the cabling spindle to the creel yarn, a workstation of a cabling machine for producing a cabling twist and a method for feeding a creel yarn using a yarn feed apparatus of this type.

7 Claims, 1 Drawing Sheet

(56) References Cited

U.S. PATENT DOCUMENTS

| | | | | | |
|---|---|---|---|---|---|
| 4,638,955 | A * | 1/1987 | Schippers | B65H 65/00 | 242/473.8 |
| 4,880,177 | A * | 11/1989 | Lenk | B65H 54/86 | 226/188 |
| 5,118,226 | A * | 6/1992 | Horii | B65G 53/58 | 406/92 |
| 5,323,982 | A * | 6/1994 | Ligon | D02H 1/00 | 242/131 |
| 5,613,643 | A * | 3/1997 | Weiner | D04B 15/42 | 242/157 R |
| 5,681,000 | A * | 10/1997 | Gobbels | B65H 54/34 | 242/475.7 |
| 2003/0167748 | A1 * | 9/2003 | Wortmann | B65H 57/003 | 57/284 |

* cited by examiner

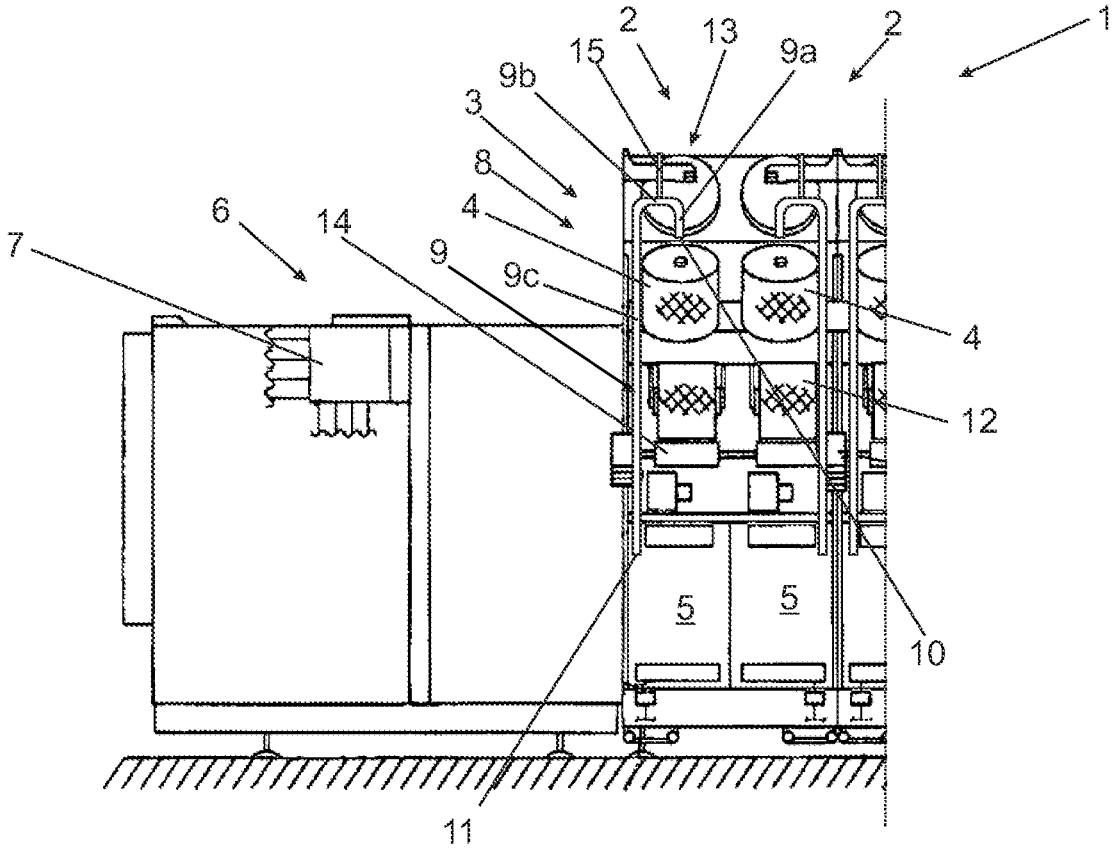
1
2
2
13
9a
15
9b
3
8
4
6
14
7
9
9c
4
12
5
5
10
11

YARN FEED APPARATUS, WORKSTATION OF A CABLING MACHINE AND METHOD FOR FEEDING

This application claims priority to German Patent Application No. 102022101248.4 filed on Jan. 20, 2022. The content of the application is incorporated herein by reference in its entirety.

The invention relates to a yarn feed apparatus for a workstation of a cabling machine for feeding a creel yarn to a cabling apparatus comprised of a cabling spindle. Furthermore, the invention relates to a workstation of a cabling machine with a yarn feed apparatus.

Twisting or cabling is a mechanical yarn-finishing method for producing a twisted yarn with certain usage properties. Cabling is a special twisting method in which two yarns are twisted together without the individual yarns themselves receiving a twist. The main advantage of twisting or cabling lies in the greater tensile strength of the yarns created.

Cabling machines typically have a variety of workstations arranged adjacent to each other in the machine longitudinal direction. Each of the workstations usually comprises a spindle, onto which an initial feed package is slid, and a slide-on device, which is arranged on the machine frame and which serves to hold a second feed package. The yarns are pulled from the feed packages and are as a rule kept at constant tension by suitable yarn brakes, cabled and wound onto a twisting package in a winding unit. During the operation of the cabling spindle, the first feed package is arranged on the rotating spindle in a spindle pot. The spindle pot and the feed package itself are secured against rotation. A so-called inner yarn is pulled axially upward from this first feed package and, on the way to the point of cabling or point of combination with the outer yarn, is guided through an inner yarn brake.

The second feed package, from which the yarn that is referred to as the creel or outer yarn is pulled, is usually arranged in a bobbin creel above the cabling apparatus. After the outer yarn has passed an outer yarn brake and optionally a deflecting device, the outer yarn enters the hollow spindle axially from below and exits at the spindle at the perimeter of a storage disc. The outer yarn rotates around the spindle pot, a yarn balloon being formed, and is led to the balloon yarn guide. At this location, the outer yarn is wound around the inner yarn, and therefore this is also called the point of cabling.

A pull-off device is arranged above the point of cabling, by means of which pull-off device the yarn is pulled off and fed to a winding device. The winding device is comprised of a drive roller, a yarn traversing device and a take-up package frictionally driven by the drive roller.

The bobbin creels of common cabling machines have as a rule two bobbin slide-in arbours in order to be able to arrange one creel yarn bobbin and one reserve package. The reserve package is then connected to the yarn end of the first bobbin by means of a knot, in order to provide continuous material flow. During commissioning, the operator's task is to take hold of the yarn end of the feed package arranged on the bobbin creel, thread it into a first yarn eyelet and a creel yarn brake, and then insert the yarn into a yarn channel of the cabling spindle. To facilitate work, the state of technology shows that the bobbin creels are arranged so that they can be lowered mechanically or pneumatically in the upper area of the cabling machine. Alternatively, in the case of so-called rigid creels, in which the bobbin slide-in arbours are rigidly arranged above the workstation, the creel yarn is gripped by the operating personnel with the aid of suitable step elevations, which are, for example, platforms that can be moved along the cabling machine or elevations extending along the machine.

However, platforms that can be moved along the machine have the disadvantage that they make it difficult to quickly rectify yarn breakage in the area of the bobbin creels. Platforms extending along the machine are arranged in the path area of the machine and thus make accessibility in the spindle area more difficult or increase the workplace load of the operating personnel during activities at the spindle due to a required stooped working posture.

On this basis, the problem addressed by the present invention is that of providing a yarn feed apparatus for a workstation of a cabling machine, a workstation of a cabling machine and a method which together enable reliable and convenient feeding of the creel yarn to the cabling process.

The present invention solves the problem by means of a yarn feed apparatus, by means of a workstation of a cabling machine, and by means of a method.

Characteristic of the yarn feed apparatus according to the invention is a creel yarn feed channel with a yarn infeed opening, which can be arranged in an area of the bobbin creel, in particular—in relation to the installation position of the workstation—above the feed package, or in an area extending from an upper section of the cabling machine to the transport conveyor, as well as a yarn outfeed opening which can be arranged in the area of the cabling apparatus, and a compressed air device for generating an air flow directed at the yarn infeed opening or yarn outfeed opening within the creel yarn feed channel. An "upper section of the cabling machine" is to be understood to mean, in the context of the present invention—with reference to the installation position of the workstation or workstations of the cabling machine—an area which preferably begins in an upper half of the cabling machine, further preferably in an upper third of the cabling machine, still further preferably in an upper quarter of the cabling machine, and extends to the uppermost point of the cabling machine which is arranged below the transport conveyor.

The creel yarn feed channel of the yarn feed apparatus according to the invention defines the yarn path of the creel or outer yarn, which is provided above the cabling apparatus in the area of the bobbin creel, e.g. drawn off from a feed package arranged on a bobbin creel or from a holder of the transport conveyor arranged above the cabling machine. The creel yarn passes via the yarn infeed opening, which can be arranged for example in the area of the bobbin creel, through the creel yarn feed channel to the yarn outfeed opening, which is arranged in the area of the cabling apparatus, from where the creel yarn can then be fed to the cabling apparatus for twisting-on in the usual manner, where it is wound around the inner yarn drawn from an additional feed package arranged on a cabling spindle.

By means of the compressed air device of the invention, it is possible to generate an air flow within the creel yarn feed channel, which is directed towards the yarn infeed opening or yarn outfeed opening. In the case of the generation of an air stream directed towards the yarn infeed opening, it is thus possible, for example, for the operating personnel to arrange the starter yarn in the yarn outfeed opening or in the area of the yarn outfeed opening and then to transport it by means of the compressed air device and the air stream directed towards the yarn infeed opening to the yarn infeed opening, where it can then be conveniently gripped by the operating personnel and connected, for example, to the yarn start of the creel yarn or, respectively, of the feed package in the bobbin creel, so that it can then be fed to the cabling process.

In the case of an air flow directed towards the yarn outfeed opening, a free end of the creel yarn is conveniently arranged by the operating personnel in the area of the yarn infeed opening and then transported due to the suction flow within the creel yarn feed channel to the yarn outfeed opening, where it is then fed to the cabling process in the usual manner.

The yarn feed device according to the invention thus enables the operating personnel to feed the outer yarn located above the cabling apparatus, e.g. from the feed package arranged at the bobbin creel, to the cabling apparatus in a comfortable manner without the use of step elevations such as steps, ladders or platforms. Yarn breaks in the area of the feed packages arranged on the bobbin creels can also be repaired quickly and reliably. Furthermore, due to the lack of need for step elevations, the workstation remains easily accessible even in the area of the cabling apparatus.

In addition, the use of the creel yarn feed channel has the further advantage that the creel yarn provided above the cabling apparatus, e.g. coming from the feed package, is reliably guided in the creel yarn feed channel. Depending on the embodiment of the creel yarn feed channel, it is also possible to dispense with the yarn pre-brakes normally required in the area of the bobbin creel, while maintaining the minimum yarn tension necessary to ensure a tight yarn path. The creel yarn feed channel also prevents a loose yarn path where the yarn could come into contact with neighbouring spindles. Any yarn brakes that may be required can be arranged in the easily accessible handling area of the operating personnel, i.e. in the area of the yarn outfeed opening.

In principle, the embodiment of the creel yarn feed channel can be freely chosen. According to a particularly advantageous embodiment of the present invention, however, the creel yarn feed channel comprises a tubular body with one or more parts. The tubular body is a body that coaxially surrounds the creel yarn or the starter yarn, thus ensuring that the creel yarn or the starter yarn, respectively, is reliably guided in the creel yarn feed channel in its entirety. In addition, the use of the tubular body has the advantage that an air flow directed towards the yarn infeed opening or yarn outfeed opening can be generated in it in a particularly simple and reliable manner by means of the compressed air device. The opening of the tubular body that can be arranged in the area of the bobbin creel, for example, forms the yarn infeed opening, whereas the opening of the tubular body that can be arranged in the area of the cabling apparatus forms the yarn outfeed opening.

The embodiment of the tubular body, in particular its course between the yarn infeed opening and the yarn outfeed opening, is basically freely selectable. According to a particularly advantageous embodiment of the invention, however, it is provided that the tubular body has two, preferably three, tube sections adjoining one another at an angle of 90°.

According to the particularly advantageously provided embodiment of the tubular body consisting of three tube sections, the tubular body has two tube sections which are essentially parallel to one another and—in relation to the position of use of the yarn feed devices at the workstation—vertically aligned, which are connected to one another in the area of the bobbin creel by an upper, horizontally running central tube section, so that the two vertically running tube sections are connected to one another essentially at an angle of 90° with the central tube section, which preferably extends in the longitudinal direction of the machine. According to this embodiment of the invention, the tubular body forms a creel yarn feed channel which—with respect to the position of use—initially extends vertically upwards from the yarn infeed opening with a first tube section. In the area of the upper end of the first tube section, the horizontally running second tube section adjoins the first tube section, which in turn is adjoined by the third tube section, which, starting from the second tube section, extends vertically downwards in the direction of the cabling apparatus to the yarn outfeed opening. A tubular body designed in this way is characterised by the fact that it provides a particularly reliable yarn path for the creel yarn. In addition, a minimum tension of the creel yarn is generated via the deflection during the yarn path, which means that a yarn brake directly at the bobbin creel can be dispensed with. Alternatively, deflection elements commonly used in cabling practice, e.g. ceramic elements or elements with rolling deflections, can be used between the tube sections.

The embodiment of the compressed air device is basically freely selectable, whereby it is designed to generate an air flow in the creel yarn feed channel directed towards the yarn infeed opening or yarn outfeed opening when activated by the operator.

According to a particularly advantageous embodiment of the invention, it is provided that the compressed air device comprises a stationary injector unit or mobile manual actuation unit designed to generate an air flow within the tubular body directed towards the yarn infeed opening.

A mobile manual actuation unit is, for example, a compressed air gun connected to a compressed air generation unit, which can be grasped manually by the operating personnel and used to generate an appropriately directed air flow in the tubular body when required. The use of a compressed air gun as a mobile manual actuation unit allows it to be used at multiple workstations. In addition, manual operation by the operating personnel ensures particularly precise metering of the air flow. If a stationary injector unit is used, it is suitably connected or connectible to the tubular body so that operating personnel can generate an air flow in the tubular body by activating the injector unit, for example via a knee lever attached to the machine. The manual actuation unit has the advantage that it can be used very flexibly. A stationary injector unit, on the other hand, is characterised by particularly reliable, simple and fast manageability. In addition, this allows the operator to use both hands for guiding the yarn forward.

The embodiment of the tubular body for connection to the compressed air device is basically freely selectable. Thus, in principle, it is possible to generate the air flow in the creel yarn feed channel or tubular body by connecting the compressed air device directly to the yarn infeed opening or yarn outfeed opening. According to a particularly advantageous embodiment of the invention, however, it is provided that the tubular body has a connection opening for connecting the compressed air device in the area between the yarn infeed opening and the yarn outfeed opening, preferably in the area of the yarn outfeed opening. According to this embodiment of the invention, the tubular body has an additional opening which serves to connect the compressed air device, by means of which a suitable air flow is then generated in the tubular body, while at the same time the yarn infeed opening and yarn outfeed opening remain freely accessible, whereby ease of operation is supplementary enhanced.

According to a further embodiment of the invention, it is further provided that the tubular body is adjustable between an operating position and a handling position where the yarn infeed opening can be shifted towards the cabling apparatus. In other words, the tubular body preferably comprises a first tubular section equipped with the yarn infeed opening and a second tubular section connectible to the first tubular section, with at least the first tubular section with the yarn infeed opening being adjustable between an operating position and the yarn infeed opening in the direction of the feed package or in a handling position that can be shifted in the direction opposite to the transport conveyor. In a particularly preferable situation, the tubular body may have an embodiment as preferred above with three tubular sections, whereby at least one of the vertical tubular sections is formed from tubular body subsections with at least two parts which can be slid into one another. The ability provided for shifts in position relative to one another enables compensation for the movement of the yarn infeed opening in such a way that at least the tubular body section with the yarn outfeed opening remains unaffected by the movement. Furthermore, the tubular body subsections, which can be slid into one another, can preferably be provided with an intermediate seal to prevent air flow losses when air flow is applied. The seal can, on the one hand, preferably be embodied to move along with the pipe, exhibiting a length along the direction of movement corresponding to the length of movement, or be arranged stationary on a pipe body section within a range of movement in order to ensure a reliable seal between the two pipe body sections that can be slid into one another. According to this embodiment of the invention, at a minimum the tubular body section with the yarn infeed opening can be adjustably arranged at the workstation, whereby in the handling position the yarn infeed opening—with respect to the use position—is adjusted in the direction of the cabling apparatus, where the yarn infeed opening is then accessible to the operating personnel in a convenient manner in the handling position. A preferable alternative is to have the entire tubular body in adjustable arrangement at the workstation in such a way that the adjustment of the tubular body causes both an adjustment of the yarn infeed opening and a simultaneous adjustment of the yarn outfeed opening. The operating position is then at a greater distance from the cabling apparatus than the handling position is. In other words, the yarn infeed opening in the operating position is further away from the cabling apparatus than in the handling position, in which case the distance is to be understood, particularly in the vertical direction, in reference to the installation position of the cabling apparatus.

In the case of an advantageously provided embodiment of the tubular body consisting of three tubular sections adjoining one another at an angle of 90° in the manner described above, there is thus the possibility of displacing the tubular body designed in this way—in relation to the position of use—in the vertical direction at the workstation, whereby in the handling position the yarn infeed opening is reliably and conveniently accessible and in the operation position the tubular body is arranged in an optimum position for the yarn path of the creel yarn. The embodiment of the yarn feed apparatus according to this embodiment makes it possible, for example, after a shifting of the tubular body into the handling position, to arrange the creel yarn in a convenient manner in the area of the yarn infeed opening and to transport it by means of an air flow directed towards the yarn outfeed opening up to the yarn outfeed, from where it can then be guided to the cabling process in a convenient manner by the operating personnel. In a particularly advantageous manner, it is provided for this purpose that the compressed air device in the handling position of the tubular body is designed to generate a suction flow directed towards the yarn outfeed opening.

According to a further preferred embodiment, the yarn feed apparatus is designed to be able to be slid along the workstations of the cabling machine. This eliminates the need to provide or arrange a yarn feed apparatus at each workstation of the cabling machine. Thus, one yarn feed apparatus can be used for at least two or more workstations.

According to an advantageous embodiment of the invention, it is provided that the yarn outfeed opening is connected to the cabling apparatus in such a way that an air flow directed towards the yarn outfeed opening is guided through a pneumatically threadable yarn brake and the cabling spindle. This embodiment of the invention makes it possible, by means of the air flow, to guide the yarn completely from the creel yarn feed through the creel yarn feed channel having three tube sections, the yarn brake and the cabling spindle, so that no second handling is then required by the operating personnel for passing through the yarn brake at the run-out point. The yarn is transported by the air stream to an area adjacent to the cabling spindle in the direction of yarn travel.

Characteristic for the workstation of a cabling machine according to the invention for producing a cabling twist from a creel yarn drawn from a feed package on a bobbin creel or a creel yarn drawn from a holder of a transport conveyor arranged above the cabling machine and an inner yarn drawn from a feed bobbin from a cabling spindle is the arrangement of a yarn feed apparatus according to the invention or further embodiment thereof in the manner described above. The workstation according to the invention is characterised by the fact that it provides the operating personnel with particularly convenient access to both the creel yarn and the cabling apparatus.

Characteristic of the method according to the invention for feeding a creel yarn at a workstation of a cabling machine to a cabling apparatus having a cabling spindle is that the following steps are carried out using a yarn feed device according to the invention or further embodied as described above:

- Generation of an air flow directed towards a yarn infeed opening or yarn outfeed opening in the yarn feed apparatus,
- arranging the starter yarn at the yarn outfeed opening or the creel yarn at the yarn infeed opening, whereby the starter yarn or the creel yarn, respectively, is drawn into the yarn outfeed opening or into the yarn infeed opening by means of the generated air flow and is transported within the creel yarn guide channel in the air flow direction and is discharged at the other opening from the yarn outfeed opening and the yarn infeed opening,
- Capture and connection of the skipped starter yarn to the creel yarn in an area outside the yarn infeed opening or manual (in particular) or automated insertion of the creel yarn into the cabling apparatus in an area of the yarn outfeed opening.

The method according to the invention makes it possible to feed the creel yarn to the cabling apparatus in a particularly simple and convenient manner. The creel yarn passes via the yarn infeed opening, which can be arranged for example in the area of a bobbin creel, through the creel yarn feed channel to the yarn outfeed opening, which is arranged in the area of the cabling apparatus, from where the creel yarn can then be fed to the cabling apparatus for untwisting in the usual manner.

By means of the compressed air device of the invention, it is possible to generate an air flow within the creel yarn feed channel, which is directed towards the yarn infeed opening or yarn outfeed opening. In the case of the generation of an air stream directed towards the yarn infeed opening, it is thus possible, for example, for the operating personnel to arrange a starter yarn in the yarn outfeed opening or in the area of the yarn outfeed opening and then to transport it by means of the compressed air device and the air stream directed towards the yarn infeed opening to the yarn infeed opening, where it can then be conveniently gripped by the operating personnel and connected, for example, to the yarn start of the feed package in the bobbin creel, so that it can then be fed to the cabling process.

In the case of an air flow directed towards the yarn outfeed opening, a free end of the creel yarn is conveniently arranged by the operating personnel in the area of the yarn infeed opening and then transported due to the air flow within the creel yarn feed channel to the yarn outfeed opening, where it is then fed to the cabling process in the usual way.

An embodiment example of the present invention is explained below with reference to a drawing.

In the drawing:

FIG. 1 shows a schematic front view of a cabling machine with a yarn feed apparatus.

FIG. 1 shows a schematic front view of a section of a cabling machine 1. Each of these kinds of textile machines has a large number of identical workstations 2 in the area of the machine longitudinal sides of such textile machines.

Such textile machines also generally feature a drive and operating unit 6 arranged at a machine end, in which drive and operating unit for example the necessary energy devices, various drives and a central control device 7 are arranged.

Each of the individual workstations 2 of the cabling machine 1 has a bobbin creel 3 for feeding an outer yarn or creel yarn, which serves to accommodate a feed package 4 from which the outer yarn or creel yarn is drawn off.

In addition, each of the workstations 2 of the cabling machine 1 has, within a cabling device 5, a cabling spindle which is not shown here but which serves to receive a second feed package from which a so-called inner yarn is drawn off, which is wound around by the outer yarn above the cabling spindle.

For feeding the creel yarn from the feed package 4 to the cabling apparatus 5, each of the workstations 2 has a yarn feed apparatus 13 equipped with a creel yarn feed channel 8, the tubular body 9 being formed from three tubular sections 9*a*, 9*b*, 9*c*, which is positioned at the workstation 2 via a carrier 15 in the area of the bobbin creel 3. A first tube section 9*a*, which with its free open end forms a yarn infeed opening 10 in the area of the feed package 4, is adjoined by a second tube section 9*b*, which runs parallel to the longitudinal direction of the machine, both vertically to the first tube section 9*a* and vertically to the third tube section 9*c*. The second tube section 9*b* thus forms a horizontally extending section of the creel yarn feed channel 8. At its end opposite the second tube section 9*b*, the third tube section 9*c* forms with its open end a yarn outfeed opening 11 in the area of the cabling apparatus 5, from which the creel yarn can be guided into the cabling apparatus 5 by the operating personnel.

To prepare for the cabling process, the operating personnel uses a compressed air device not shown here, for example a compressed air gun or a knee-operated injector device, by means of which a starter yarn is transported via the yarn outfeed opening 11 by a suitable air flow to the yarn infeed opening 10, where the starter yarn can be knotted to a free end of the creel yarn and then fed to the cabling process, whereby the creel yarn then passes through the creel yarn feed channel 8.

In an alternative embodiment not shown here, the creel yarn feed channel 8 is vertically adjustable between an operating position shown in FIG. 1 and a handling position not shown here—with respect to the position of use—wherein, in the handling position, the yarn infeed opening 10 is vertically adjusted in the direction of the take-up package 12 on which the produced twisted yarn is wound, driven by a drive roller 14.

In the handling position, it is possible for the operating personnel to conveniently transport the free end of the creel yarn arranged on the feed package 4 from the yarn infeed opening 10 to the yarn outfeed opening 11 by means of a compressed air device, for example a manually operated compressed air gun, wherein for this purpose an air flow is generated by the compressed air device starting from the yarn infeed opening 10 to the yarn outfeed opening 11, so that the yarn reaches the yarn outfeed opening 11 by means of the suction flow. The free end of the creel yarn in the area of the yarn outfeed opening 11 can be fed to the cabling apparatus 5 by the operating personnel.

LIST OF REFERENCE SIGNS

1 Cabling machine
2 Workstation
3 Bobbin creel
4 Feed package
5 Cabling apparatus
6 Drive and operation unit
7 Control device
8 Creel yarn feed channel
9 Tubular body
9*a* First tube section
9*b* Second tube section
9*c* Third tube section
10 Yarn infeed opening
11 Yarn outfeed opening
12 Take-up package
13 Yarn feed apparatus
14 Drive roller
15 Carrier

The invention claimed is:

1. A cabling machine (1), comprising:

a bobbin creel (3) and a cabling apparatus (5);

a workstation (2) of the cabling machine (1), configured to feed a creel yarn from a feed package (4) of the bobbin creel (3) of the cabling machine (1) to the cabling apparatus (5) equipped with a cabling spindle and/or for feeding a starter yarn from the cabling spindle of the cabling apparatus (5) to the creel yarn; and a yarn feed apparatus (13), comprising:

a creel yarn feed channel (8) with a yarn infeed opening (10), positioned in an area of the bobbin creel (3) in an area above the feed package (4); and a yarn outfeed opening (11), positioned in an area of the cabling apparatus (5).

2. The cabling machine (1) according to claim 1, wherein the creel yarn feed channel (8) comprises a single-part or multi-part tubular body (9).

3. The cabling machine (1) according to claim 2, wherein the tubular body (9) comprises two or three tube sections (9*a*, 9*b*, 9*c*) adjoining each other at an angle of 90°.

4. The cabling machine (1) according to claim 2, wherein the tubular body (9) comprises:

a first tube section (9*a*) equipped with the yarn infeed opening (10); and a second tube section (9*b*) connectible to the first tube section (9*a*), for which at least the first tube section (9*a*) is equipped with the yarn infeed opening (10).

5. The cabling machine (1) according to claim 1, wherein the yarn outfeed opening (11) is connected to the cabling apparatus (5).

6. A cabling machine (1), comprising:

a workstation (2) configured to:

feed a creel yarn from a feed package (4) of a bobbin creel (3) of the cabling machine (1) to a cabling apparatus (5) equipped with a cabling spindle and/or feed a starter yarn from the cabling spindle of the cabling apparatus (5) to the creel yarn; and produce a cabling twist from a creel yarn drawn from a feed package (4) on a bobbin creel (3) and an inner yarn drawn from a further feed package (4) on a cabling spindle; and a yarn feed apparatus (13), comprising:

a creel yarn feed channel (8) with a yarn infeed opening (10), positioned in an area of the bobbin creel (3) in an area above the feed package (4).

7. A method for feeding a creel yarn at a workstation (2) of a cabling machine (1) to a cabling apparatus (5) equipped with a cabling spindle, comprising:

generating an air flow directed towards a yarn infeed opening (10) or yarn outfeed opening (11), arranging a starter yarn at the yarn outfeed opening (11) or the creel yarn at the yarn infeed opening (10) whereby the starter yarn or the creel yarn, respectively, is drawn into the yarn outfeed opening (11) or into the yarn infeed opening (10) by means of the generated air flow and is transported within a creel yarn guide channel (8) in an air flow direction in an area of a bobbin creel (3) in an area above a feed package (4), and capturing and connecting starter yarn to the creel yarn in an area outside the yarn infeed opening (10) or insertion of the creel yarn into the cabling apparatus (5) in an area of the yarn outfeed opening (11).

* * * * *